US008251101B2

(12) United States Patent
Yoshino et al.

(10) Patent No.: US 8,251,101 B2
(45) Date of Patent: Aug. 28, 2012

(54) REFRIGERANT PIPING UNIT AND METHOD OF MANUFACTURING PIPE FOR THE SAME

(75) Inventors: Makoto Yoshino, Okazaki (JP); Hiroki Naganawa, Nishio (JP); Naka Shibata, Azumino (JP); Masakazu Kondou, Higashichikuma-gun (JP)

(73) Assignees: Denso Corporation, Kariya (JP); GAC Corporation, Azumino (JP)

( * ) Notice: Subject to any disclaimer, the term of this patent is extended or adjusted under 35 U.S.C. 154(b) by 762 days.

(21) Appl. No.: 12/316,021

(22) Filed: Dec. 9, 2008

(65) Prior Publication Data

US 2009/0145152 A1 Jun. 11, 2009

(30) Foreign Application Priority Data

Dec. 11, 2007 (JP) ..... 2007-320023

(51) Int. Cl.
*F16L 3/00* (2006.01)

(52) U.S. Cl. ..... 138/107; 138/106; 138/109

(58) Field of Classification Search ..... 138/106, 138/107, 109

See application file for complete search history.

(56) References Cited

U.S. PATENT DOCUMENTS

| | | | | |
|---|---|---|---|---|
| 1,906,011 | A * | 4/1933 | Naylor | 138/109 |
| 2,413,878 | A * | 1/1947 | Maky | 285/220 |
| 3,370,815 | A * | 2/1968 | Opperthauser | 248/74.2 |
| 4,435,174 | A * | 3/1984 | Redmond et al. | 604/174 |
| 5,625,948 | A | 5/1997 | Kuroda et al. | |
| 5,853,201 | A * | 12/1998 | Izumi et al. | 285/179 |
| 6,330,739 | B1 | 12/2001 | Ito | |
| 6,575,502 | B1 | 6/2003 | Ridenour | |
| 6,908,117 | B1 | 6/2005 | Pickett, Jr. | |
| 6,935,377 | B2 * | 8/2005 | Furugen | 138/109 |
| 7,007,981 | B2 | 3/2006 | Yoshino | |

FOREIGN PATENT DOCUMENTS

| | | |
|---|---|---|
| JP | 07-012283 | 1/1995 |
| JP | 09-001247 | 1/1997 |
| JP | 09-085367 | 3/1997 |
| JP | 11-300436 | 11/1999 |
| JP | 2004-084765 | 3/2004 |
| JP | 2004-150788 | 5/2004 |
| JP | 2004-251333 | 9/2004 |

OTHER PUBLICATIONS

Office action dated Sep. 21, 2011 in corresponding German Application No. 10 2008 060 098.9.

Notification of Reason(s) for Refusal mailed Feb. 14, 2012 in a corresponding Japanese Application No. 2007-320023 with English translation thereof.

* cited by examiner

*Primary Examiner* — James Hook

(74) *Attorney, Agent, or Firm* — Harness, Dickey & Pierce, PLC

(57) ABSTRACT

A refrigerant piping unit includes a pipe and a joint coupled to the pipe. The pipe includes a main section, an end section and a bent section between the main section and the end section. The end section includes a flange portion adjacent to the bent section and a thick end portion opposite to the bent portion with respect to the flange portion in an axial direction. The flange portion is expanded in a radially outward direction and is engaged with the joint. The thick end portion is expanded in the radially outward direction and has a thickness greater than a thickness of the main section. The thick end portion has a groove on its outer surface. The end section has a flat inner surface extending continuously from an inner surface of the bent section throughout inside of the flange portion and the thick end portion.

8 Claims, 5 Drawing Sheets

REFRIGERANT PIPING UNIT AND METHOD OF MANUFACTURING PIPE FOR THE SAME

CROSS REFERENCE TO RELATED APPLICATION

This application is based on Japanese Patent Application No. 2007-320023 filed on Dec. 11, 2007, the disclosure of which is incorporated herein by reference.

FIELD OF THE INVENTION

The present invention relates to a refrigerant piping unit and a method of manufacturing a pipe for the refrigerant piping unit.

BACKGROUND OF THE INVENTION

A refrigerant piping unit used for providing a refrigerant passage of a refrigerant cycle apparatus, is described in U.S. Pat. No. 6,330,739, for example. The refrigerant piping unit has a pipe defining a refrigerant passage therein and a joint for coupling the pipe. The pipe is bent substantially perpendicular to include a bent portion with a small radius of curvature so as to make the pipe compact. An end of the pipe is inserted in the joint member. The pipe has a fixing flange adjacent to the bent portion. The pipe is fixed to the joint member through the fixing flange. Further, the end of the pipe is formed with a groove and an O-ring is fitted in the groove.

In the described piping unit, an inner surface of the end of the pipe is uneven since the fixing flange and the groove are formed. Such an uneven inner surface causes disturbance of refrigerant, resulting an increase in pressure loss and a decrease in cooling performance of a system to which the refrigerant piping unit is employed.

SUMMARY OF THE INVENTION

The present invention is made in view of the foregoing matter, and it is an object of the present invention to provide a refrigerant piping unit capable of reducing pressure loss of refrigerant flowing therein. It is further object of the present invention to provide a method of manufacturing a pipe for a refrigerant piping unit capable of reducing pressure loss of refrigerant flowing therein.

According to an aspect of the present invention, a refrigerant piping unit includes a pipe and a joint coupled to the pipe. The joint serves as a coupling member for coupling the pipe to another member. The pipe includes a main section, an end section and a bent section between the main section and the end section. The end section of the pipe includes a flange portion adjacent to the bent section and a thick end portion opposite to the bent portion with respect to the flange portion in an axial direction. The flange portion is expanded in a radially outward direction and is engaged with the joint. The thick end portion is expanded in the radially outward direction and has a thickness greater than a thickness of the main section. The thick end portion has a groove on its outer surface for receiving an O-ring. The end section has a flat inner surface extending continuously from an inner surface of the bent section throughout inside of the flange portion and the thick end portion.

Accordingly, even in the pipe in which the flange portion and the thick end portion with the groove have been formed adjacent to the bent section, the end section has the flat inner surface throughout the inside of the flange portion and the thick end portion. As such, turbulence of refrigerant flowing inside of the pipe is reduced, and hence pressure loss is reduced.

In such a construction, since the groove is formed within the thick end portion, a thickness of the thick end portion is not excessively reduced at a position where the groove is formed. That is, the wall of the thick end portion where the groove is formed has a sufficient thickness.

As an example of forming the end section, first, an end of the pipe is expanded in a radial direction. An expanded end has a first expanded portion and a second expanded portion between the first expanded portion and a non-expanded portion corresponding to the bent section. Then, the flange portion is formed by increasing a thickness of the second expanded portion such that an inner surface of the second expanded portion is brought to coincide with an inner surface of the non-expanded portion with respect to the radial direction while maintaining a thickness of the first expanded portion and a position of an outer surface of the first expanded portion with respect to the radial direction. Thereafter, the thick end portion is formed by transforming the first expanded portion such that at least a part of an inner surface of the first expanded portion is brought to coincide with an inner surface of the flange portion with respect to the radial direction while increasing a thickness of the first expanded portion. Thus, the thick end portion having the groove on the outer surface is formed.

As another example of forming the end section, after the end of the pipe is expanded, the flange portion is formed by increasing the thickness of the second expanded portion such that the inner surface of the second expanded portion is brought to coincide with the inner surface of the non-expanded portion with respect to the radial direction. At this time, the first expanded portion is transformed such that the inner surface is brought to coincide with the inner surface of the non-expanded portion with respect to the radial direction, and a transformed first expanded portion has a thickness equal to a thickness before being transformed. Thereafter, the thick end portion is formed by transforming a part of the first expanded portion such that an outer surface is brought to coincide with an outer surface of the flange portion with respect to the radial direction and the thickness of the first expanded portion is increased. Thus, the thick end portion having the groove on the outer surface is formed.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS (First Embodiment)

Figure 1A:
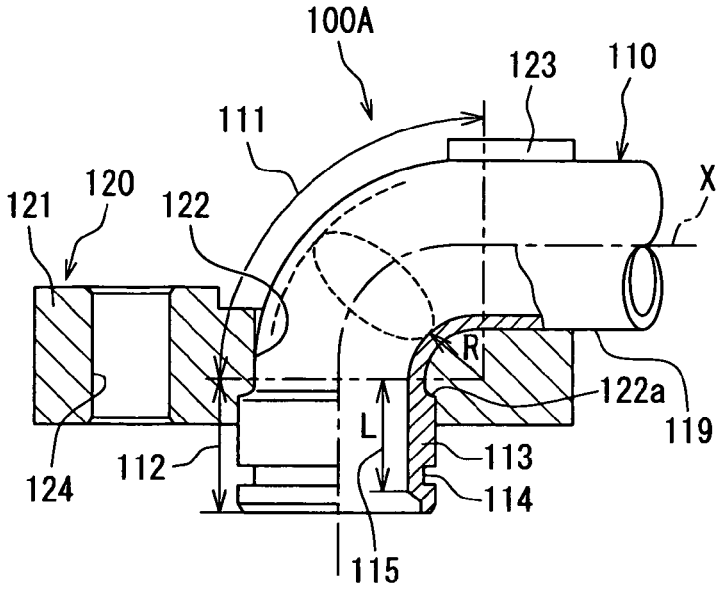
FIG. 1A is a schematic cross-sectional view of a refrigerant piping unit according to a first embodiment of the present invention.
Figure 1B:
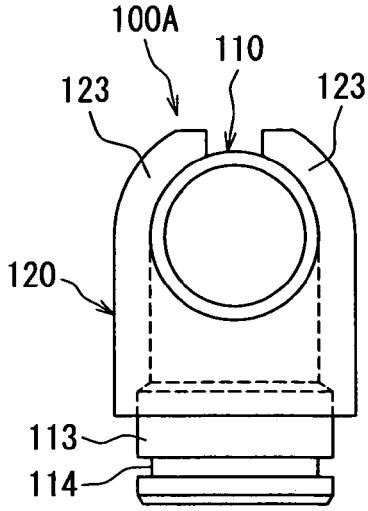
FIG. 1B is an end view of the refrigerant piping unit according to the first embodiment.

A first embodiment of the present invention will now be described with reference to FIGS. 1A to 5. Referring to FIGS. 1A and 1B, a refrigerant piping unit 100A is exemplarily used for connecting respective devices, such as a compressor, a condenser, a decompressing device and an evaporator, of a refrigerant cycle apparatus of a vehicle air conditioner.

The refrigerant piping unit 100A generally includes a pipe 110 and a joint 120 as a coupling member for coupling the pipe 110 to another member such as another pipe or a coupling portion of another device.

The pipe 110 is made of a metal, such as aluminum or aluminum alloy. The pipe 110 defines a passage therein through which refrigerant flows. The pipe 110 has a generally L-shape. The pipe 110 includes a main section (e.g., straight section) 119 having a tubular shape, an end section 112 to be coupled to another pipe or a passage of another device, and a bent section 111 between the straight section 119 and the end section 112.

The pipe 110 is bent at the bent section 111 such that an inner side of the bent section 111 forms a curved inner wall having a predetermined radius R of curvature. Also, an outer side of the bent section 111 forms a curved outer wall having a radius of curvature larger than the predetermined radius R. For example, the radius of curvature of the curved outer wall is larger than the predetermined radius R by a diameter of the pipe 110. The pipe 110 is bent into a generally L-shape such that an axis of the straight section 119 is approximately perpendicular to an axis of the end section 112. In the drawings, a chained line X denotes a longitudinal axis of the pipe 110.

The end section 112 extends from a first end of the bent section 111, such as a lower end of the bent section 111 in FIG. 1A. The end section 112 includes a flange portion 113 at which a thickness is increased in a radial direction and a groove portion 114 adjacent to the flange portion 113 in an axial direction. The flange portion 113 is adjacent to the first end of the bent section 111, and is closer to the bent section 111 than the groove portion 114.

The flange portion 113 is configured by increasing an outer diameter of the end section 112 without reducing an inner diameter of the end section 112. That is, an inner surface of the end section 112, which defines a passage, is flat even inside of the flange portion 113. The flange portion 113 provides a relatively long tubular portion. Thus, the flange portion 113 extends from an inside of the joint 120 to an outside of the joint 120 when the pipe 110 is coupled to the joint 120.

The groove portion 114 forms a groove 114*a* on an outer surface. The groove 114*a* is formed adjacent to an end of the flange portion 113, the end being further than the bent section 111. Although not illustrated, an O-ring is fitted in the groove 114*a*. Thus, the groove 114*a* is hereinafter referred to as the O-ring groove 114*a*.

The thickness of the flange portion 113 is sufficiently larger than a depth of the O-ring groove 114*a* in the radial direction. The end section 112 includes a tapered portion at which an inner diameter increases as a function of distance from the flange portion 113, and an end tubular portion at which the inner diameter is larger than the inner diameter of the flange portion 113. The tapered portion extends from the O-ring portion 114. The end tubular portion extends from the tapered portion toward the end of the pipe 110.

For example, an axial length of the end tubular portion is less than an axial length of the flange portion 113. An outer wall of the tapered portion and the end tubular portion define an end of the O-ring groove 114*a* and provides a cylindrical outer surface at a distal end of the end section 112.

The end section 112 has a flat inner surface 115 in a region where the flange portion 113 and the O-ring groove 1141 are formed. The flat inner surface 115 extends continuously from an inner surface of the first end of the bent section 111 to the tapered portion in the axial direction. The flat inner surface 115 is even or flat in the axial direction without having projections and recesses.

A cross-sectional area of the pipe 110, that is, a passage area provided in the pipe 110 is substantially constant from the straight section 119 to the end section 112 through the bent section 111. An outer surface of the end tubular portion is chamfered at an end. An inner diameter of the end tubular portion is slightly larger than the inner diameter of the flange portion 113 and the groove portion 114.

An outer diameter portion of the flange portion 113 is expanded in a radially outward direction more than an outer diameter portion of a general section of the pipe 110 including such as the bent section 111 and the straight section 119. That is, the flange portion 113 has a thick portion having the outer diameter greater than an outer diameter of the general section of the pipe 110 including the bent section 111. The flange portion 113 is located adjacent to the first end of the bent section 111 within the end section 112.

The groove portion 114 is located adjacent to the flange portion 113 within the end section 112. The groove portion 114 has a thickness greater than the thickness of the general section of the pipe 110 including the bent section 111. The O-ring groove 114*a* is formed within the groove portion 114. The groove portion 114 corresponds to a thick end portion 118, which will be described later.

Figure 2:
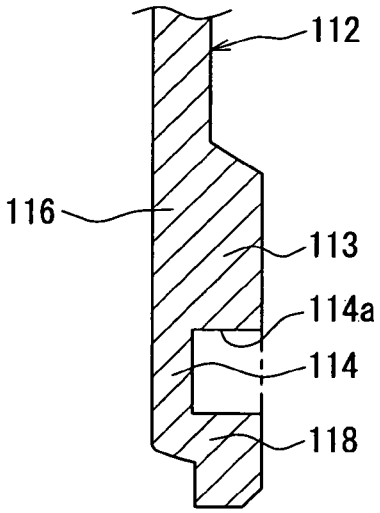
FIG. 2 is an enlarged cross-sectional view of an end section of a pipe of the refrigerant piping unit according to the first embodiment.

In an example shown in FIGS. 1A to 2, the flange portion 113 and the thick end portion 118 have the same thickness. The outer surface of the flange portion 113 and an outer surface of the thick end portion 118 are coincide with each other with respect to the radial direction. The thickness of each of the flange portion 113 and the thick end portion 118 is substantially twice of the thickness of the general section of the pipe 110.

The O-ring groove 114*a* is formed within the thick end portion 118, and is provided as a recess recessed from the outer surface of the thick end portion 18 in a radially inward direction. The O-ring groove 114*a* has a substantially rectangular shape in a cross-section defined in the axial direction. The depth of the O-ring groove 114*a* is substantially half of the thickness of the thick end portion 118. Thus, an inner wall of the thick end portion 118 where the O-ring groove 114*a* is formed has a thickness substantially equal to the thickness of the general portion of the pipe 110. Also, a thickness of a wall between the tapered portion and the O-ring groove 114*a* is substantially equal to the thickness of the general portion of the pipe 110.

The joint 120 constitutes a coupling member for coupling the pipe 110 to another member such as another pipe. The joint 120 is made of a metal, such as aluminum or aluminum alloy, similar to the pipe 110. The joint 120 includes a joint body 121 formed with a through hole 122, a pair of clamping nail portions 123, a bolt hole 124, and the like.

The joint body 121 is a block having a generally flat rectangular parallelepiped shape. The through hole 122 is formed at a substantially middle portion of the joint body 121 and passes through the joint body 121 in a widthwise direction (e.g., up and down direction in FIG. 1A) perpendicular to a longitudinal direction of the joint body 121. The through hole 122 has a circular base dimension having a diameter slightly greater than an outer diameter of the pipe 110.

The joint body 121 forms a step portion 122*a* so that the diameter of the through hole 122 is increased larger than the diameter of the circular base dimension at an end of the joint body 121. In other words, the through hole 122 includes a smaller diameter portion and a larger diameter portion on opposite sides of the step portion 122*a*. The larger diameter portion having a diameter larger than that of the smaller diameter portion. The larger diameter portion has an axial length smaller than an axial length of the flange portion 113. For example, the axial length of the larger diameter portion is approximately half of the axial length of the flange portion 113. Thus, at least a part of the flange portion 113 of the pipe 110 is received in the larger diameter portion of the through hole 122 and engaged with the step portion 122*a*.

The smaller diameter portion is configured to receive the bent section 111 of the pipe 110. The shape of the smaller diameter portion varies from the circular shape to an elliptic shape along the shape of the bent section 111, as a function of distance from the larger diameter portion. The smaller diameter portion provides a smoothly curved surface along the bent section 111. That is, the opening of the through hole 122 smoothly expands toward an end of the joint body 121 in a longitudinal direction of the joint body 121 so as to be in contact with an inner side of the bent section 111.

The pair of clamping nail portions 123 are provided at the end of the joint body 121 at which the opening of the through hole 122 expands. A wall of the joint body 121 between the pair of clamping nail portions 123 is curved along an outer surface of the straight section 119 of the pipe 110 so as to be in contact with the outer surface of the straight section 119 of the pipe 110. Before the joint 120 is coupled to the pipe 110, the pair of clamping nail portions 123 extend straight in a direction perpendicular to the longitudinal direction of the joint body 121 and are parallel to each other. When the joint 120 is coupled to the pipe 110, ends of the clamping nail portions 123 are bent along the outer surface of the straight section 119 of the pipe 110 to clamp the pipe 110, as shown in FIG. 1B.

The bolt hole 124 is provided as a hole in which a bolt is inserted when the pipe 110 is coupled to another member such as another pipe. The bolt hole 124 is located at the other end of the joint body 121 with respect to the longitudinal direction, and pass through the joint body 121 in the widthwise direction of the joint body 121.

In the piping unit 100A, the pipe 110 is coupled to the joint 120 in such a manner that the bent section 111 and the end section 112 pass through the through hole 122, the flange portion 113 is engaged with the step portion 122*a*, and the portion of the straight section 119 extending from the second end of the bent section 111 is clamped by the clamping nail portions 123.

Since the flange portion 113 is in contact with the step portion 122*a* and the portion of the straight section 119 is clamped by the clamping nail portions 123, the pipe 110 is connected to the joint 120 in a condition that a movement in the axial direction of the end section 112 is restricted and a rotational movement about the axis of the end section 112 is restricted.

Next, a method of manufacturing the refrigerant piping unit 100A will be described.

First, a straight pipe member and the joint 120 having straight clamping nail portions 123 are prepared. An end of the straight pipe member is inserted in the through hole 122, and then the straight pipe member is bent using a predetermined bending device. Thus, a bent portion corresponding to the bent section 111 is formed in the pipe member. Alternatively, the pipe member can be inserted in the through hole 122 of the joint 120 after the bent portion is formed.

Then, the end of the pipe member is processed to have the flange portion 113 and the groove portion 114 including the O-ring groove 114*a* by a forming method described later. Thus, the pipe member becomes the pipe 110 as shown in FIGS. 1A to 2. The portion of the straight section 119 of the pipe 110 is clamped by bending the clamping nail portions 123 of the joint 120. In this way, the refrigerant piping unit 100A shown in FIGS. 1A to 2 is manufactured.

Figure 3A:
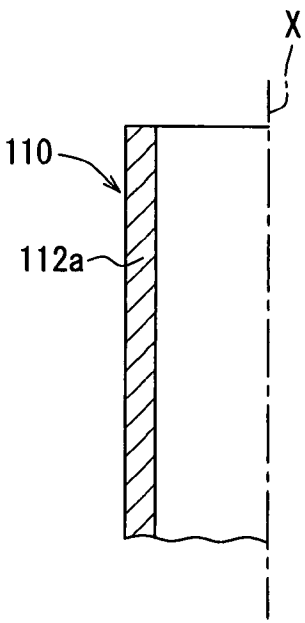
FIGS. 3A to 3D are schematic cross-sectional views for showing steps of forming a flange portion and a groove portion in the end section of the pipe according to the first embodiment.

Next, the forming method of forming the flange portion 113 and the groove portion 114 with the O-ring groove 114 will be described with reference to FIGS. 3A to 3D. In FIGS. 3A to 3D, the end section 112 is illustrated in a direction opposite to the illustration in FIGS. 1A to 2 in the axial direction, according to the direction during the forming. FIG. 3A shows the pipe 110 before the end section 112 is formed.

<Expanding Step>

Figure 3B:
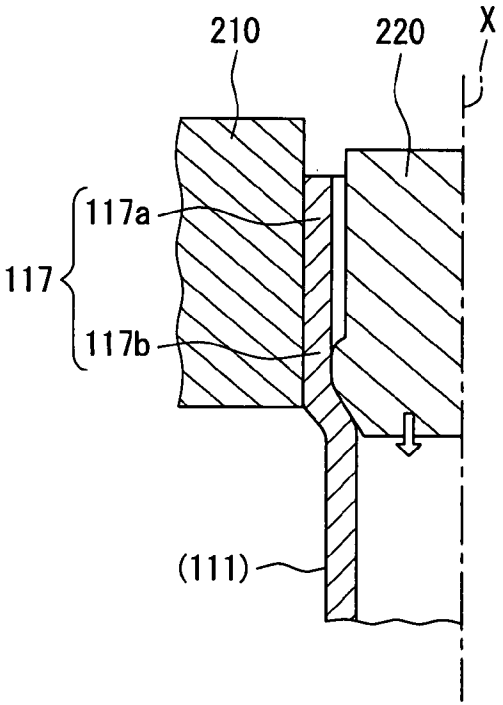

An outer die 210 is arranged radially outside of an end 112*a* of the pipe 110, the end 112*a* corresponding to the end section 112. The outer die 210 has a bore having an inner diameter corresponding to an outer diameter of the flange portion 113. Then, an expansion punch 220 is inserted inside of the end 112*a* of the pipe 110 to expand the end of the pipe 110 in a radially outward direction. That is, an inner surface of the end of the pipe 110 is displaced from an inner surface of a non-expanded portion of the pipe 110 including the bent section 111 in the radially outward direction. Thus, an expanded part 117 with a predetermined length is formed, as shown in FIG. 3B In this case, the expanded part 117 is formed by expanding the end 112*a* of the pipe 110 while substantially maintaining the thickness of the end 112*a* of the pipe 110. Hereinafter, an end of the expanded part 117, that is, an upper portion of the expanded part 117 in FIG. 3B is referred to as a first expanded portion 117*a*. The other portion of the expanded part 117, that is, a lower portion of the expanded part 117 in FIG. 3B, which is adjacent to the bent section 111, is referred to as a second expanded portion 117*b*.

<Thickness Increasing Step>

Figure 3C:
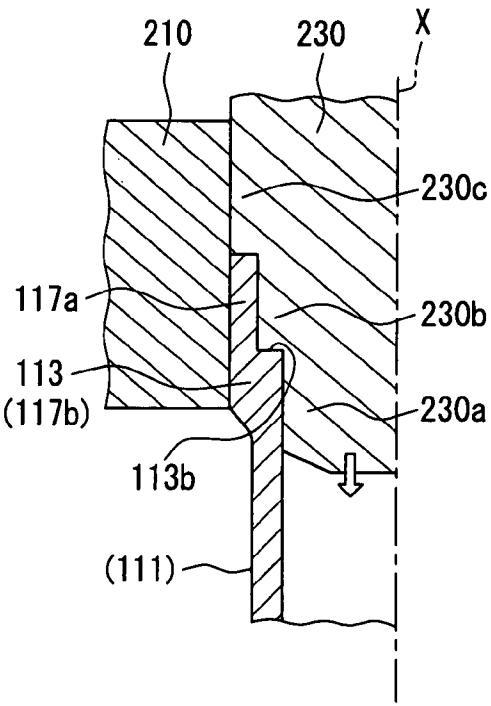

Referring to FIG. 3C, a compression punch 230 is inserted inside of the expanded part 117 in a condition that the outer die 210 is held on the outside of the expanded part 117. The compression punch 230 includes a first portion (end portion) 230*a*, a second portion (middle portion) 230*b*, and a third portion 230*c*. An outer diameter of the compression punch 230 increases stepwise from the first portion 230*a* toward the third portion 230*c*.

The first portion 230*a* has an outer diameter substantially equal to an original inner diameter of the end 112*a* of the pipe 110. The second portion 230*b* has an outer diameter that is smaller than the inner diameter of the bore of the outer die 210 by an original thickness of the end 112*a* of the pipe 110 such that a dimension between the outer surface of the second portion 230*b* and the inner surface of the outer die 210 is substantially equal to the original thickness of the end 112*a* of the pipe 110. Further, the third portion 230*c* has an outer diameter substantially equal to the inner diameter of the bore of the outer die 210.

When the compression punch 230 is inserted in the expanded part 117, the expanded part 117 is compressed in the axial direction and in the radial direction. Specifically, when being compressed by the compression punch 230, the material of the first expanded portion 117*a* is moved in the axial direction while maintaining the thickness and a location of an outer surface in the radial direction, and mainly the material of the second expanded portion 117*b* (inner wall of the second expanded portion 117*b*) is moved into a clearance provided between the outer surface of the first portion 230*a* of the compressing die 230 and the inner surface of the outer die 210.

Thus, the thickness of the second expanded portion 117*b* is increased greater than the original thickness of the end 112*a* of the pipe 110, and the inner diameter of the second expanded portion 117*b* becomes equal to the original inner diameter of the end 112*a* of the pipe 110. That is, an inner surface of the second expanded portion 117*b* is brought to be coincide with a location of the inner surface of the non-expanded portion in the radial direction. The flange portion 113 is provided by the portion where the thickness is increased. In other words, the flange portion 113 is formed by transforming the second expanded portion 117*b*. In this case, since the thickness of the first expanded portion 117*a* is maintained, a step 113*b* is provided between the flange portion 113 and the first expanded portion 117*a*.

<O-Ring Groove Forming Step>

Figure 3D:
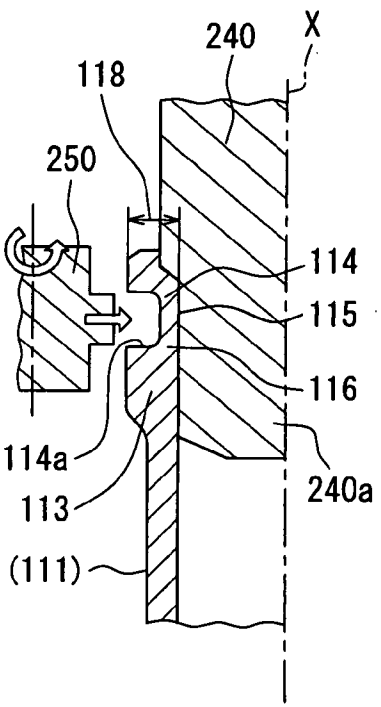

Referring to FIG. 3D, an inner die 240 is inserted inside of the first expanded portion 117*a* and the flange portion 113. The inner die 240 has an end portion 240*a* having an outer diameter equal to the original inner diameter of the end 112*a* of the pipe 110 and a step at which the outer diameter increases. Further, a forming roller 250 is pressed against the outer surface of the first expanded portion 117*a* in a radially inward direction while being rotated. The forming roller 250 has a projection having a shape corresponding to the O-ring groove 114*a*.

When the inner die 240 is inserted inside of the first expanded portion 117*a* and the flange portion 113, a clearance is provided between an inner surface of the first expanded portion 117*a* and an outer surface of the end portion 240*a* of the inner die 240. Thus, when the forming roller 250 is pressed against the first expanded portion 117*a*, the material of the first expanded portion 117*a* moves in the clearance, and hence the clearance is filled with the material of the first expanded portion 117*a*. For example, the material of the first expanded portion 117*a* is moved as bending over the step 113*b*. Accordingly, the thick end portion 118 with the O-ring groove 114 is formed by transforming the first expanded portion 117*a*.

In such a case, the pressed portion of the first expanded portion 117*a* is moved in the radially inward direction such that an inner surface coincide with the inner surface of the flange portion 113 with respect to the radial direction. Thus, the end section 112 can have the flat inner surface 115 throughout inside of the flange portion 113 and the thick end portion 118, as shown in FIG. 3D, although the flange portion 113 and the O-ring groove 114*a* have been formed. The flat inner surface 115 is even and extends continuously from the inner surface of the bent section 111 without having projections and recesses. In this way, the end section 112 as shown in FIGS. 1A to 2 is formed.

Since the material of the first expanded portion 117*a* moves over the step 113*b* of the flange portion 113 when being pressed by the projection of the forming roller 250, the step 113*b* is transformed into a connecting portion 116 connecting between the flange portion 113 and the thick end portion 118. Thus, a connecting line extending in a circumferential direction remains on the inner surface 115.

Accordingly, the groove portion 114 with the O-ring groove 114*a* and the flange portion 113 are formed in the pipe 110 adjacent to the bent section 111. The thick end portion 118, that is, the groove portion 114 is formed by increasing the thickness in the radially outward direction. Further, the thick end portion 118 and the flange portion 113 are formed to have the flat inner surface 115 extending continuously from the inner surface of the bent section 111.

By the above discussed forming method, the end section 112 can have the flat inner surface 115, which is even throughout the inside of the flange portion 113 and the thick end portion 118 in the axial direction, although the flange portion 113 and the groove portion 114 have been formed adjacent to the bent section 111. In the pipe 110, therefore, pressure loss due to turbulence of the refrigerant flow is not increased. In a case that the piping unit 100A having the pipe 110 is employed in the refrigerant cycle, a decrease in cooling efficiency is suppressed.

Since the O-ring groove 114*a* is formed within the thick end portion 118, therefore, the groove portion 114 has a sufficient thickness.

Figure 4:
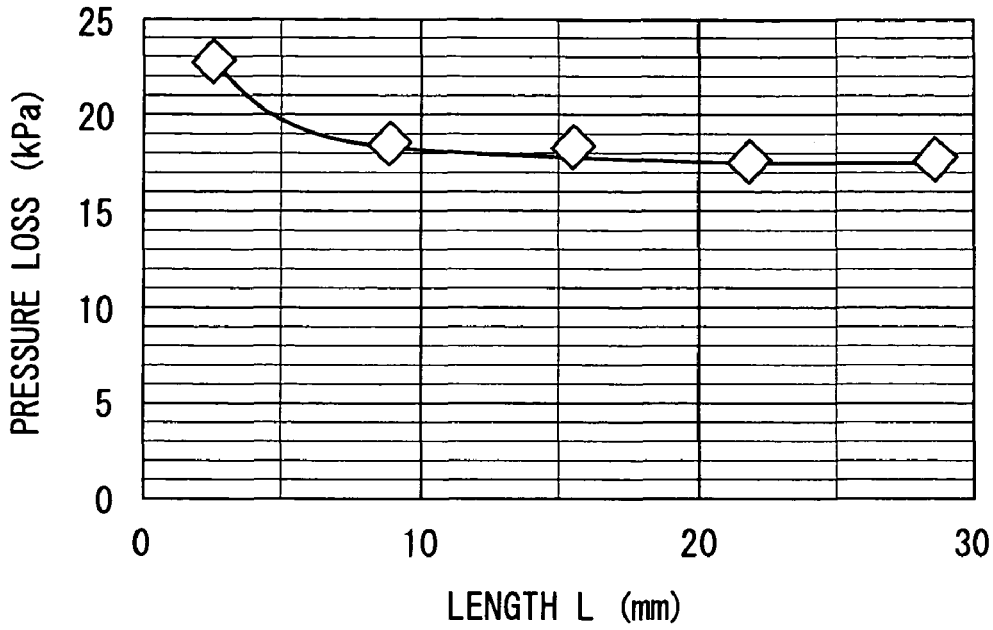
FIG. 4 is a graph showing pressure loss of refrigerant with respect to a length of a flat inner surface of an end section of the pipe according to the first embodiment.

The pressure loss of the refrigerant reduces with an increase in the axial length L of the flat inner surface 115. FIG. 4 shows a relationship between the axial length L of the flat inner surface 115 and the pressure loss. FIG. 4 shows a measurement result of an actual unit in which a rate of decrease in the cross-sectional area of the bent section 111 with respect to the cross-sectional area of the general portion of the pipe 110 is 26% (the worst condition) and the flow rate of the refrigerant is 13 $m^3$/h. According to the result shown in FIG. 4, it is confirmed that the pressure loss reduces as the axial length L increases, and it is preferable to maintain the axial length L equal to or greater than 9 mm.

Figure 5:
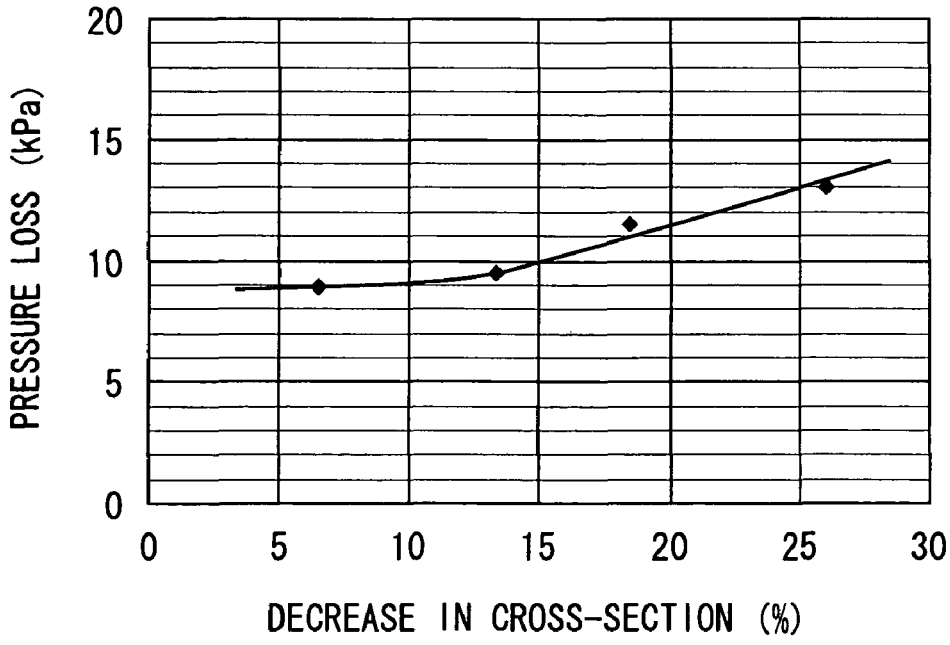
FIG. 5 is a graph showing pressure loss of refrigerant with respect to a rate of decrease in cross-section of a bent section of the pipe according to the first embodiment.

Further, the pressure loss reduces with a decrease in the rate of decrease in the cross-sectional area of the bent section 111. FIG. 5 shows a relationship between the rate of decrease in the cross-sectional area with respect to the pressure loss. FIG. 5 shows a measurement result of an actual unit in which the axial length L is 9 mm and the flow rate of the refrigerant is 11 $m^3$/h. According to the result shown in FIG. 5, it is confirmed that the pressure loss reduces as the rate of decrease in the cross-sectional area of the bent section 111 reduces, and it is preferable that the rate of decrease in the cross-sectional area of the bent section 111 is equal to or less than 13%.

(Second Embodiment)

A second embodiment of the present invention will now be described with reference to FIGS. 6A to 6D. In the present embodiment, the flange portion 113 and the O-ring groove 114*a* are formed in a different manner as that of the first embodiment. That is, the thickness increasing step and the O-ring groove forming step are modified.

Figure 6D:
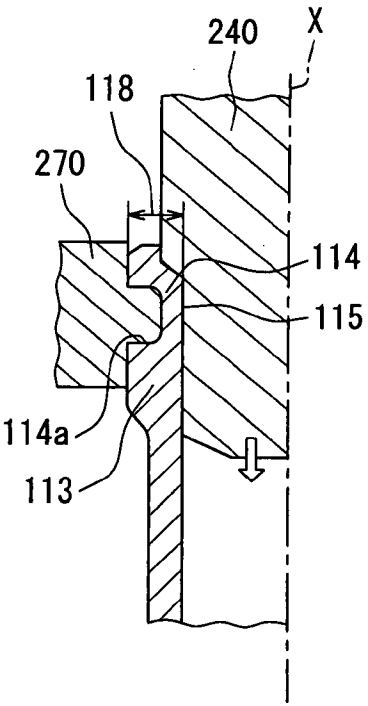
FIGS. 6A to 6D are schematic cross-sectional views for showing steps of forming a flange portion and a groove portion in an end section of a pipe of a refrigerant piping unit according to a second embodiment of the present invention.
Figure 6C:
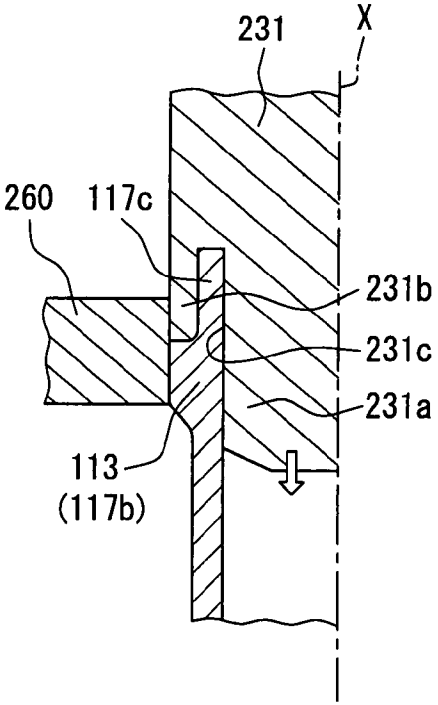
Figure 6B:
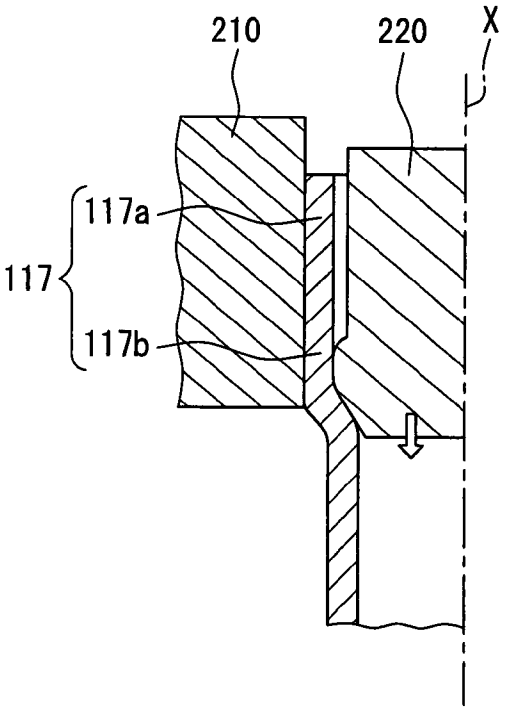
Figure 6A:
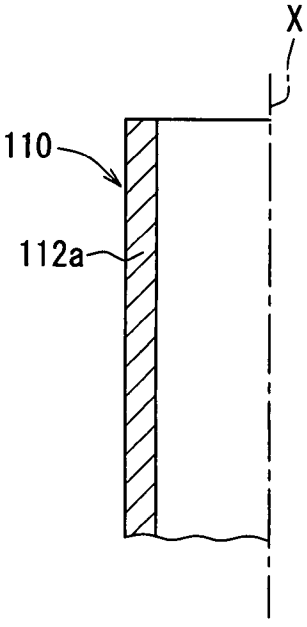

Referring to FIGS. 6A and 6B, the expanded part 117 is formed in the end 112*a* of the pipe 110 in the similar manner as that of the first embodiment shown in FIGS. 3A and 3B, the end corresponding to the end section 112. Next, as shown in FIG. 6C, an outer die 260 is set to outside of the expanded part 117, and the expanded part 117 is compressed by a compression punch 231.

The compression punch 231 has a double structure including an inner punch portion 231*a* having a cylindrical shape and an outer punch portion 231*b* having a ring shape, at an end (e.g., lower end in FIG. 6C) to be inserted in the expanded part 117. The outer punch portion 231*b* is located outside of the inner punch portion 231*a*, and a clearance 231*c* is provided between the outer punch portion 231*b* and the inner punch portion 231*a*. The inner punch portion 231*a* has an outer diameter substantially equal to the original inner diameter of the end 112*a* of the pipe 110. The outer punch portion 231*b* has an outer diameter substantially equal to the outer diameter of the expanded part 117 formed by the expanding step shown in FIG. 6B. Further, the dimension of the clearance 231*c* in the radial direction is substantially equal to the original thickness of the end 112*a* of the pipe 110. The inner punch portion 231*a* is longer than the outer punch portion 231*b*. That is, the end of the inner punch portion 231*a* is protruded more than the end of the outer punch portion 231*b* in the axial direction.

The expanded part 117 is compressed in the axial direction and the radial direction by the compression punch 231. Specifically, when being compressed by the compression punch 231, the material of the second expanded portion 117*b* is moved toward the inner punch portion 231*a*, such that the thickness of the second expanded portion 117*b* is increased larger than the original thickness of the end 112*a* of the pipe 110, and the inner diameter of the second expanded portion 117*b* becomes equal to the original inner diameter of the end 112*a* of the pipe 110. That is, the flange portion 113 is provided by the thick portion.

Further, the material of the first expanded portion 117*a* is moved inside of the clearance 231*c*, and a transformed end portion 117*c* is formed. The transformed end portion 117*c* has an inner diameter equal to the original inner diameter of the end 112*a* and a thickness equal to the thickness of the first expanded portion 117*a*.

Next, as shown in FIG. 6D, the O-ring groove 114*a* is formed. Here, an outer die 270 having a projection having a shape corresponding to the shape of the O-ring groove 114*a* is set to an outer surface of the transformed end portion 117*c*. In this case, the outer die 270 is set such that a lower surface of the projection fits a step between the flange portion 113 and the transformed end portion 117*c*. Further, the inner die 240 having the same shape as that of the first embodiment is inserted inside of the transformed end portion 117*c*. At this time, the material of the transformed end portion 117*c* is moved toward the outer die 270 over an upper surface of the projection of the outer die 270. As such, the thick end portion 118 with the O-ring groove 114*a* is formed.

Accordingly, the flat inner surface 115 can be formed inside of the end section 112 although the flange portion 113 and the O-ring groove 114*a* have been formed. The flat inner surface 115 is even in the axial direction and extends continuously from the inner surface of the bent section 111.

The end section 112 having the shape shown in FIGS. 1A to 2 can be formed also by the forming method of the present embodiment. Also in the pipe 110 formed in the above method, the pressure loss due to the turbulence of the refrigerant flow is reduced, similar to the first embodiment.

(Other Embodiments)

The structure of the joint 120 is not limited to the above discussed structure shown in FIGS. 1A to 2, but can be modified in various ways. FIGS. 7A to 8B show modifications of the joint 120.

Figure 7A:
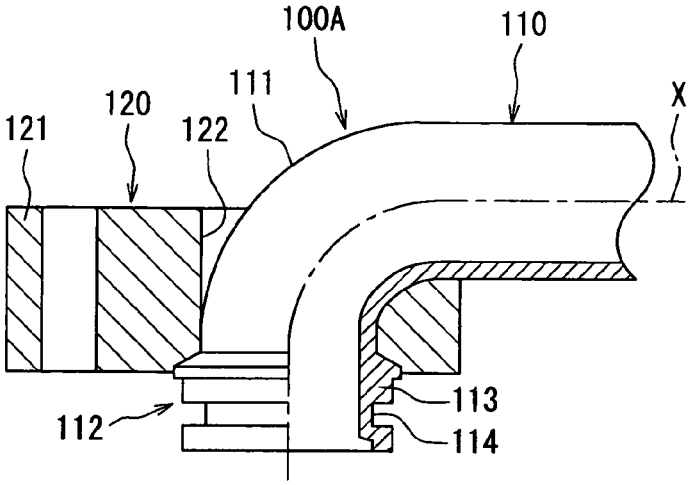
FIG. 7A is a schematic cross-sectional view of a refrigerant piping unit according to another embodiment of the present invention.
Figure 7B:
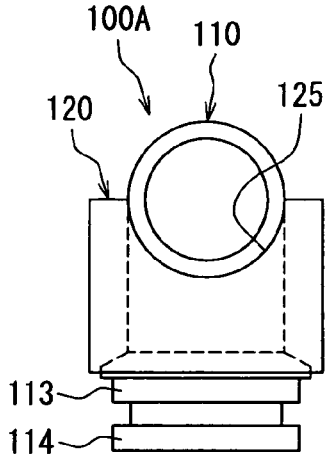
FIG. 7B is an end view of the refrigerant piping unit shown in FIG. 7A.

In the modification shown in FIGS. 7A and 7B, the joint 120 does not have the clamping nail portions 123. Instead, the opening of the through hole 122 smoothly expands toward the second end of the joint body 121 in the longitudinal direction of the joint body 121. The joint body 121 has a housing portion 125 defining a recess for receiving the bent section 11 and at least a portion of the straight section 119. The recess of the housing portion 125 has a predetermined depth such that a half of the circumference of the pipe 110 is held in the housing portion 125.

Figure 8A:
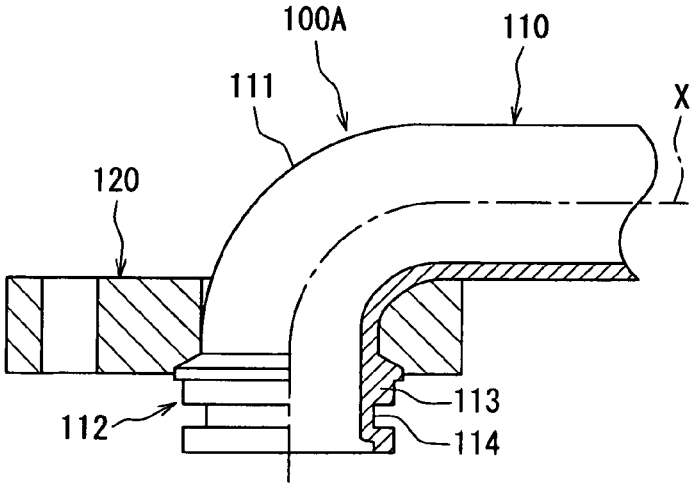
FIG. 8A is a schematic cross-sectional view of a refrigerant piping unit according to further another embodiment of the present invention.
Figure 8B:
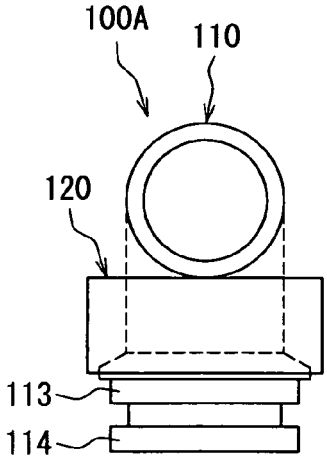
FIG. 8B is an end view of the refrigerant piping unit shown in FIG. 8A.

In the modification shown in FIGS. 8A and 8B, the joint 120 does not have the clamping nail portions 123. Instead, the pipe 110 is fixed to the joint 120 such that the second end of the bent section 111 and/or the portion of the straight section 119 is in contact with a surface of the joint 120.

In the above embodiments, the refrigerant piping unit 100A is exemplarily employed in the refrigerant cycle of the vehicle air conditioner. However, the refrigerant piping unit 100A may be employed to any other purposes, such as for a domestic air conditioner and the like.

Additional advantages and modifications will readily occur to those skilled in the art. The invention in its broader term is therefore not limited to the specific details, representative apparatus, and illustrative examples shown and described.

What is claimed is:

1. A refrigerant piping unit comprising:

a pipe having a substantially L-shape including a main section, an end section and a bent section between the main section and the end section, the bent section providing a rounded corner having a smooth rounded inner surface; and a joint coupled to the pipe, the joint constituting a coupling member for coupling the pipe to another member, wherein the end section of the pipe includes a flange portion adjacent to the bent section and a thick end portion opposite to the bent section with respect to the flange portion in an axial direction, the flange portion is expanded in a radially outward direction and is engaged with the joint, the thick end portion is expanded in the radially outward direction and has a thickness greater than a thickness of the main section, the thick end portion has a groove on its outer surface for receiving an O-ring, the end section has a flat inner surface extending continuously and smoothly from the smooth rounded inner surface of the bent section throughout an inside of the flange portion and the thick end portion;

at least a part of the bent section is disposed inside of the joint, and the flat inner surface of the end section extends from a position inside of the joint to a position outside of the joint.

2. The refrigerant piping unit according to claim 1, wherein the inner surface of the end section has an axial length equal to or greater than 9 mm.

3. The refrigerant piping unit according to claim 1, wherein the pipe is configured such that a rate of decrease in a cross-sectional area of the bent section with respect to a cross-sectional area of the main section is equal to or less than 13%.

4. The refrigerant piping unit according to claim 1, wherein the joint includes a joint body and a pair of clamping nails extending from the joint body, and the pair of clamping nails clamps an end of the main section, the end connecting to the bent section.

5. The refrigerant piping unit according to claim 1, wherein the joint is formed with a housing portion, and the pipe is fixed to the joint such that the bent section and a portion of the main section are housed in the housing portion.

6. The refrigerant piping unit according to claim 1, wherein the joint has a fixing surface, and the pipe is fixed to the joint such that an end of the main section is in contact with the fixing surface of the joint, the end connecting to the bent section.

7. The refrigerant piping unit according to claim 1, wherein the end section is coupled to the joint so that a first end of the flange portion is disposed inside of the joint and a second end of the flange portion is located outside of the joint.

8. The refrigerant piping unit according to claim 1, wherein the refrigerant piping defines a fluid passage and a cross-sectional area of the fluid passage is substantially constant from the main section to the end section through the bent section.

* * * * *